United States Patent [19]

Lilja et al.

[11] Patent Number: 4,601,785

[45] Date of Patent: Jul. 22, 1986

[54] FELT COMPRISING A LOOP SEAM FOR USE IN THE PRESS SECTION OF PAPERMAKING MACHINES AND A METHOD OF MANUFACTURING SUCH FELTS

[75] Inventors: Roland E. Lilja, Skärblacka; Sven B. Nilsson, Dals-Långed, both of Sweden

[73] Assignee: Albany International Corp., Menands, N.Y.

[21] Appl. No.: 546,050

[22] Filed: Oct. 27, 1983

[30] Foreign Application Priority Data

Nov. 2, 1982 [SE] Sweden ..... 8206222

[51] Int. Cl.[4] ..... D21F 7/10; D21F 3/00

[52] U.S. Cl. ..... 162/199; 28/141; 162/200; 162/273; 162/358; 162/DIG. 1; 139/383 A

[58] Field of Search ..... 162/199, 200, DIG. 1, 162/272, 273, 358; 28/141; 428/300; 156/304.3, 304.5, 304.4; 139/383 A, 383 AA, 425 A

[56] References Cited

U.S. PATENT DOCUMENTS

| | | | |
|---|---|---|---|
| 2,883,734 | 4/1959 | Draper, Jr. | 28/141 |
| 2,893,007 | 7/1959 | DeWindt | 28/141 |
| 2,907,093 | 10/1959 | Draper, Jr. | 28/141 |
| 3,283,388 | 11/1966 | Kelleha et al. | 28/141 |
| 4,427,734 | 1/1984 | Johnson | 428/300 |

*Primary Examiner*—S. Leon Bashore
*Assistant Examiner*—K. M. Hastings
*Attorney, Agent, or Firm*—Kane, Dalsimer, Kane

[57] ABSTRACT

A felt for use in the press section of papermaking machines. The felt consists of a woven base preferably of two layers of threads extending in the machine direction of the felt and cross-machine direction threads interconnect the machine-direction threads, the woven base having a batt needed onto at least one of its faces. The felt is manufactured to be installed in flat form but after its installation in the machine its ends are joined together to form an endless cloth with the aid of a seam known per se. A flap of the batt or batts is arranged to cover the seam area. The invention also concerns a method of manufacturing and installing the felt in the press section of papermaking machines.

11 Claims, 3 Drawing Figures

Figure 1:
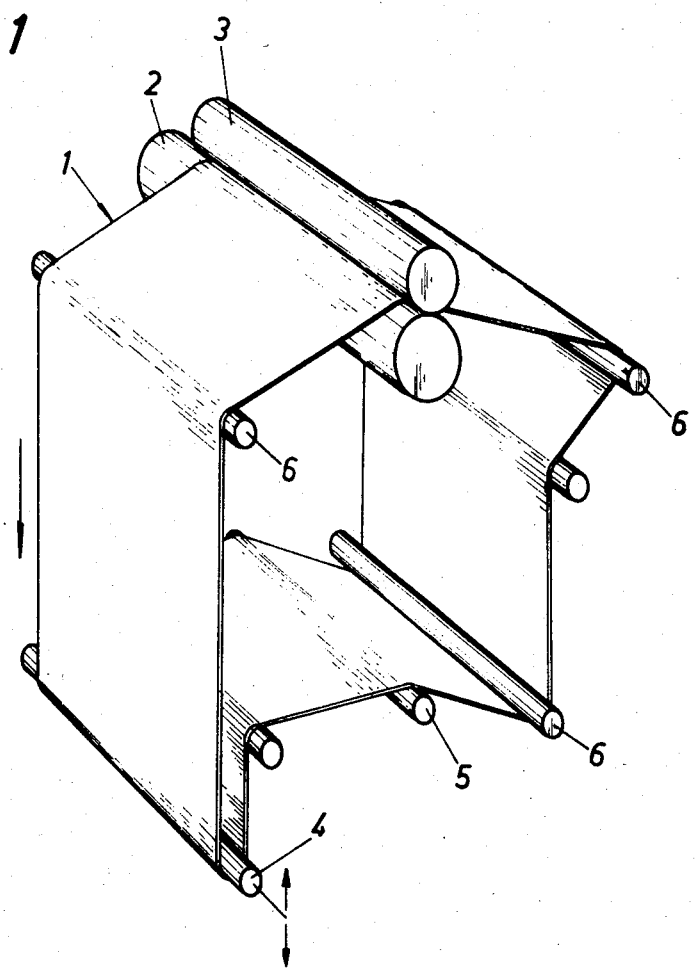

FELT COMPRISING A LOOP SEAM FOR USE IN THE PRESS SECTION OF PAPERMAKING MACHINES AND A METHOD OF MANUFACTURING SUCH FELTS

BACKGROUND OF THE INVENTION

The subject invention relates to a press felt for use in papermaking, cellulose and similar machines and particularly to a press felt provided with a loop-type seam by means of which the ends of the flat woven felt are joined together in the papermaking machine to form an endless cloth. The invention also concerns a method of manufacturing and installing press felts of the kind referred to.

Papermaking machines comprise three main sections, usually referred to as the forming section, the press section and the dryer section. To the forming section is supplied a fibrous suspension often comprising less than 1% fibres which are to be formed into a paper sheet on the forming fabric. When the sheet thus formed leaves the forming section is has a moisture content of between 70 and 80 percent, depending on the type of papermaking machine used.

Following the forming section the thus formed sheet 6 is passed through the press section wherein the sheet is advanced on a press felt in through the press nip between the press rolls, where water is removed from the sheet. The press section may include several press nips and it is important that a maximum amount of the remaining water is removed in this section, as this allows a reduction of the energy consumption in the ensuing drying process. When the sheet leaves the press section its moisture contents usually are reduced to values below 60 percent.

From the press section the sheet is transferred to the dryer section wherein moisture is transferred from the sheet through heat. This reduces the moisture contents in the sheet to values below 10 percent, in many cases down to approximately 5 percent.

Like other papermaking cloths press felts have undergone remarkable developments during the past twenty years. It is characteristic of the modern press felt that it comprises a soft part which is positioned closest to the paper web and serves to protect the latter, and an incompressible part designed to receive water from the paper sheet and carry it away from the press nip. In addition, the demands on felt evenness are considerable since the smallest irregularity or unevenness necessarily leads to damages to the paper sheet. Further, felt unevenness may be the cause of vibration generated upon passage of the felt through the press nip. As an example of the magnitude of the pressure applied could be mentioned that the normal press felt thickness of between 3 to 4 millimeters is reduced in the press nip to about 1.5 millimeters.

The requirements that press felts, as explained above, thus have to meet have led to the general opinion among experts in the field that only felts that are produced in endless form, that is felts woven in tubular form or joined felts, may be used. Seams of the kind used in dryer felts or dryer fabrics have been considered inevitably to damage and even to cause sheet breaks. The high speeds, up to approximately 1000 m/min, at which the felt and the sheet operate in many of up-to-date papermaking machines, have been considered to cause vibration upon passage of the seams of the kind referred to through the press nip. Although in U.S. Pat. Nos. 2,883,734 and 2,907,093 are disclosed press felts incorporating a loop seam these prior-art press felts are not known ever to have been used in practice. Based on the knowledge of the prior-art technology and on experience from the development work that has led to the subject invention the inventors consider it to be evident that loop seams used in conventionally woven, single-layer felts and wherein no protection is provided for the seam loops, are predestined to failure.

Despite the suggestions in the two U.S. patent specifications referred to it has hitherto been taken for granted that the only viable possibility is to use press felts which are woven in tubular form or are joined to endless form. Without exception, all press sections to date are constructed with expensive means and systems allowing the press rolls in the press section to be raised to allow new felts to be installed. The incompressibility of the press felts increases the rigidity of the press felts, which makes their installation and mounting more difficult.

SUMMARY OF THE INVENTION

It is with a view to solve these problems that the felt incorporating a seam in accordance with the subject invention has been designed. The felt in accordance with the teachings of the subject invention consists of a woven base having a batt needled thereto on one or both sides. The woven base preferably consists of at least two layers of machine-direction threads and of cross-machine direction threads interconnecting the machine direction threads. At least the machine-direction threads preferably are monofilaments which could be single or twisted. Multifilament threads and spun yarns may be used but when they are they may be made rigid through chemical treatment. It is characteristic of the subject invention that the machine-direction ends of the woven base are joined together by a seam of a kind known per se and that a flap of the needled-on batt (batts) is arranged to cover the seam zone after the woven base ends have been joined together.

The invention also comprises a method of manufacturing and installing a felt of the kind referred to. The batt (batts) is cut behind the seam, as seen in the intended direction of travelling of the felt, down to the level of the woven base and is loosened off the woven base in a zone extending along and on either side of the seam. The seam connector or pintle wire is removed and the felt is mounted in the press section of the papermaking machine, whereupon the felt ends are again joined together by re-introduction of the pintle wire or connector through the seam loops. The loosened flat (flaps) of the batt (batts) preferably are re-attached to the woven base after the joining operation.

One of the advantages inherent in the subject invention is that the seam, owing to the arrangement of at least two layers of machine-direction threads, becomes thinner than the reminder of the felt and is protected by the covering flap of the batt. This is the decisive factor allowing the use of a loop seam in press felts.

One advantage of using a seam in press felts is the possibility it offers to change the felts without first raising the rolls in the press section. The simplified felt-change procedure results in shorter standstill periods and thus higher production in the machine. In newly-produced machines the press-section construction can be simplified, which means cost savings when new press sections are to be installed. In addition, the press section may be made more compact and also the space around the press section may be considerably reduced.

A further advantage is the possibility of installing the felt in flat condition, thus without first having to fold and gather it. This is an important factor, particularly in connection with modern rigid press felts. Previously, the installation of such rigid felts has been difficult.

Press felts incorporating a seam in accordance with the subject invention could be advantageously used also in the first dryer-section group and be conducted into the press section to pick up the web. In this manner it is possible to arrange a closed transfer between the press and dryer sections.

BRIEF DESCRIPTON OF THE DRAWINGS

Figure 2:
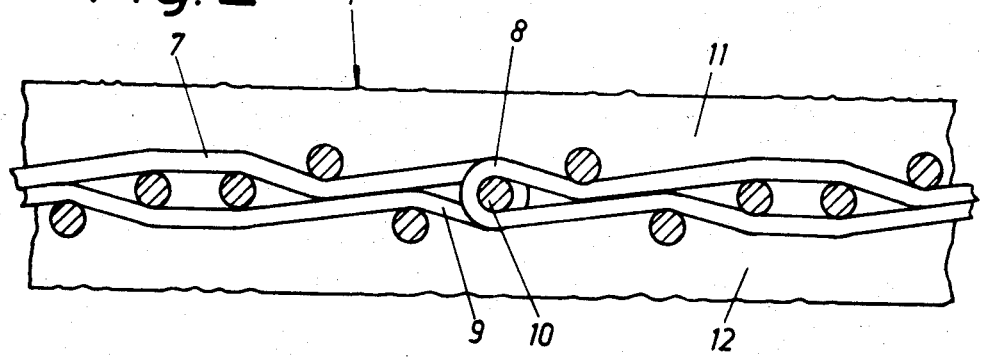
Figure 3:
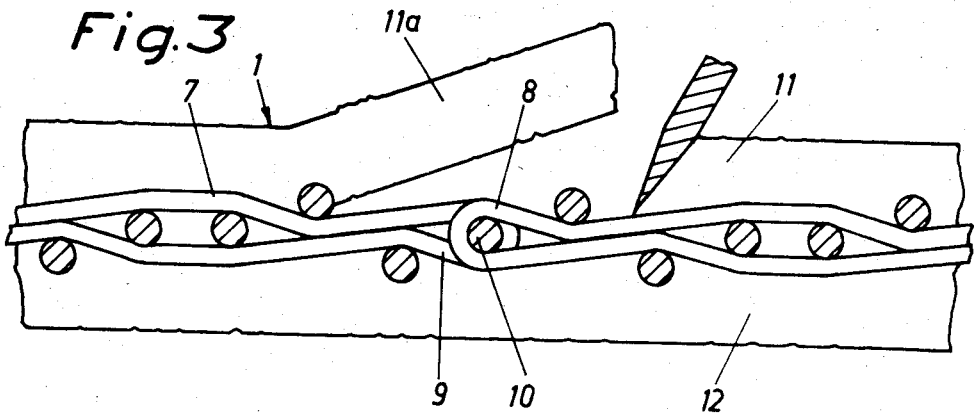

The invention will be described in closer detail in the following with reference to the accompanying drawings, wherein FIG. 1 is a schematic perspective view of a part of the press section of a papermaking machine, and FIGS. 2 and 3 are sections through a press felt in accordance with the subject invention including the seam therein.

DETAILED DECRIPTION OF A PREFERRED EMBODIMENT

FIG. 1 illustrates a part of the press section of a papermaking machine. Through this section a press felt 1 travels between two press rolls 2 and 3 and around a number of guide rolls as well as around a stretch roll 4 and a movable guide roll 5. When an endless press felt 1 is to be installed, the rolls 2, 4 and 6, which are positioned in contact with the inner face of the felt, must be raised from their bearings on one side of the machine.

The felt will be mounted over the roll ends in gathered condition. Modern press felts are heavy, rigid and difficult to handle and manipulate, in addition to which considerable space is required around the machine in order to make it possible to change the felt at all. The felt-installation work in some cases is considered to be so difficult that a softer felt, although having poorer dewatering properties as compared with more rigid ones, is nevertheless preferred in order to facilitate the installation of the felt. Felt-installation also cause long expensive operational stoppages.

FIGS. 2 and 3 are sections through a felt comprising a woven base 7. The felt is given an endless form by providing its ends with loops 8 and 9 which in a manner known per se are arranged in intermeshing relationship and locked in this position by means of insertion through the loops 8, 9 of a pintle wire or connector 10. On top of the base 7 is then attached in a needling operation an upper batt layer 11 and a bottom batt layer 12. Behind the seam loops 8, 9, as seen in the intended direction of travel of the felt in the machine, the upper batt 11 is cut through in the manner indicated in FIG. 3 and a piece **11*a* thereof is loosened in the area, across the seam and somewhat beyond the seam itself. It should be understood that in felts comprising also a bottom batt layer 12 a corresponding operation must be made with regard to the bottom batt. It is then possible to pull out the pintle wire 10** and the felt is then in a flat form.

A felt thus prepared can then be carried around the rolls of the press section in the same manner as dryer felts or dryer fabrics in the dryer section and consequently it is no longer necessary to raise the rolls. When the felt has been thus carried through its path of travel the loops are joined together with the aid of the pintle wire or connector. Preferably, the loosened flap **11*a*** of the batt (or batts) is again re-attached to the woven base, for instance in a needling or glueing operation. The installation of press felts in accordance with the subject invention in the machine is quicker than has hitherto been possible and the operational stoppages briefer, and above all the novel method of installation means that the work involved becomes infinitely easier than before.

The invention is not limited to the embodiments shown in the drawings and described in the aforegoing but a number of modifications are possible within the scope of the appended claims. The loosened flap **11*a* of the batt 1 illustrated in FIG. 3 need not be re-attached prior to starting the machine. Neverless, it is probably preferable that the flap 11*a* is attached in some way. This could be done for instance through needling, glueing or in other similar ways after the felt 1** having been mounted and installed in the press section. In accordance with the invention it has thus, quite unexpectedly, been found that it is possible to use felts incorporating a seam in the press section of papermaking machines without this use in any way involving disadvantages and inconveniences that all experts in the field have hitherto regarded as inevitable.

What we claims is:

1. A felt for use in the press section of a papermaking machine comprising:

a base having machine-direction and cross-machine direction threads and having first and second base ends; a seam for selectively joining and releasing said first and second base ends; and batt having first and second batt ends, said batt further having first and second longitudinal portions corresponding to the machine direction, said first longitudinal portion being attached to said base with said first batt end spaced at a predetermined distance away from said first base end to leave a section of the base exposed and said second longitudinal portion corresponding to the machine direction being a continuation of said first longitudinal portion and extending past said second base end to form a flap;

whereby the felt may be installed on said papermachine press section by the opening of said seam to release said two base ends and position said felt in an operational configuration enabling the closing of said seam with said flap extending over said closed seam and said section of exposed base.

2. The felt of claim 1 wherein said batt is attached to said base by needling.

3. The felt of claim 1 wherein said first portion is attached to said base by needling.

4. The felt of claim 1 wherein said seam is provided by loops formed by said machine direction threads.

5. The felt of claim 1 wherein said machine direction threads consist of at least two layers.

6. A method of making a felt for use in the press section of a papermaking machine comprising:

providing a woven base having first and second base ends;

joining said first and second base ends by a releasable seam;

attaching a batt continuously around said base;

cutting said batt along a first line parallel with and spaced in the machine direction away from said seam; and loosening said batt away from said first line to a second line on the opposite side of said seam to form a flap;

whereby the felt may be installed on said papermachine press section by opening the seam, positioning the felt in an operational configuration on the press section, and reclosing said seam.

7. The method of claim 6 whereby said batt is attached to said base by needling.

8. The method of claim 6 wherein said flap is attached to said base after the felt is installed.

9. The method of claim 8 wherein said flap is attached to the base by needling.

10. The method of claim 8 wherein said flap is attached to the base by gluing.

11. A press section of a papermaking machine including in combination, a stretch roll, guide roll means, a felt passing thereover, and first and second press rolls engaging said felt on either side thereof, said felt comprising:

a felt for use in the press section of a papermaking machine comprising a base having machine-direction and cross-machine direction threads and having first and second base ends; a seam for selectively joining and releasing said first and second base ends; and batt having first and second batt ends, said batt further having first and second longitudinal portions corresponding to the machine direction, said first longitudinal portion being attached to said base with said first batt end spaced at a predetermined distance away from said first base end to leave a section of the base exposed and said second longitudinal portion corresponding to the machine direction being a continuation of said first longitudinal portion and extending past said second end to form a flap; whereby the felt may be installed on said papermachine press section by the opening of said seam to release said two base ends and position said felt in an operational configuration enabling the closing of said seam with said flap extending over said closed seam and said section of exposed base.

* * * * *